US008176601B2

(12) United States Patent
Orr

(10) Patent No.: US 8,176,601 B2
(45) Date of Patent: May 15, 2012

(54) DEVICE FOR RELEASABLY SECURING A FLEXIBLE BAG ABOUT THE RIM OF A SUPPORTING RECEPTACLE

(76) Inventor: Kirk A. Orr, Spokane, WA (US)

( * ) Notice: Subject to any disclaimer, the term of this patent is extended or adjusted under 35 U.S.C. 154(b) by 383 days.

(21) Appl. No.: 12/459,539

(22) Filed: Jul. 2, 2009

(65) Prior Publication Data

US 2010/0001003 A1 Jan. 7, 2010

Related U.S. Application Data

(60) Provisional application No. 61/133,992, filed on Jul. 3, 2008.

(51) Int. Cl.
*B65D 33/00* (2006.01)

(52) U.S. Cl. ..... 24/30.5 R; 24/30.5 T; 242/388.1

(58) Field of Classification Search ..... 24/30.5 R, 24/30.5 T, 71.1, 68 T, 71 T; 242/388.1, 388.2, 242/388.4

See application file for complete search history.

(56) References Cited

U.S. PATENT DOCUMENTS

| | | | | | |
|---|---|---|---|---|---|
| 196,392 | A | * | 10/1877 | Smith | 242/388.4 |
| 671,955 | A | * | 4/1901 | Gunn | 242/388.2 |
| 3,874,638 | A | * | 4/1975 | Langlie et al. | 242/388.2 |
| 4,800,628 | A | * | 1/1989 | Farnsworth | 242/388.2 |
| 6,012,686 | A | | 1/2000 | Julian | |
| 6,918,505 | B2 | | 7/2005 | Gifford, Sr. | |

* cited by examiner

*Primary Examiner* — Robert J Sandy
(74) *Attorney, Agent, or Firm* — William A. Jeckle

(57) ABSTRACT

A fastener for releasably securing a flexible trash bag type liner about the outer upper peripheral rim of a supporting receptacle has an elongated body with a first leg and an interconnected second leg defining a space there-between. An axially movable rotation handle carried at one end portion of the body facilitates rotating the body axially to wind an excess portion of an edge portion of the flexible trash bag type liner about the body and prevents the unwinding of the excess portion of the liner from the body.

6 Claims, 3 Drawing Sheets

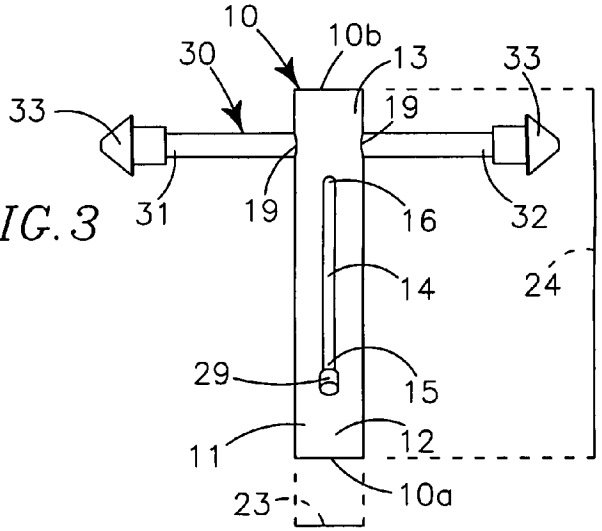
FIG. 3
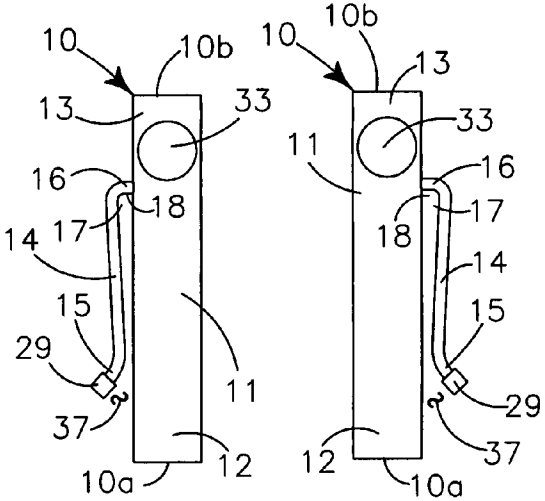
FIG. 5
FIG. 4
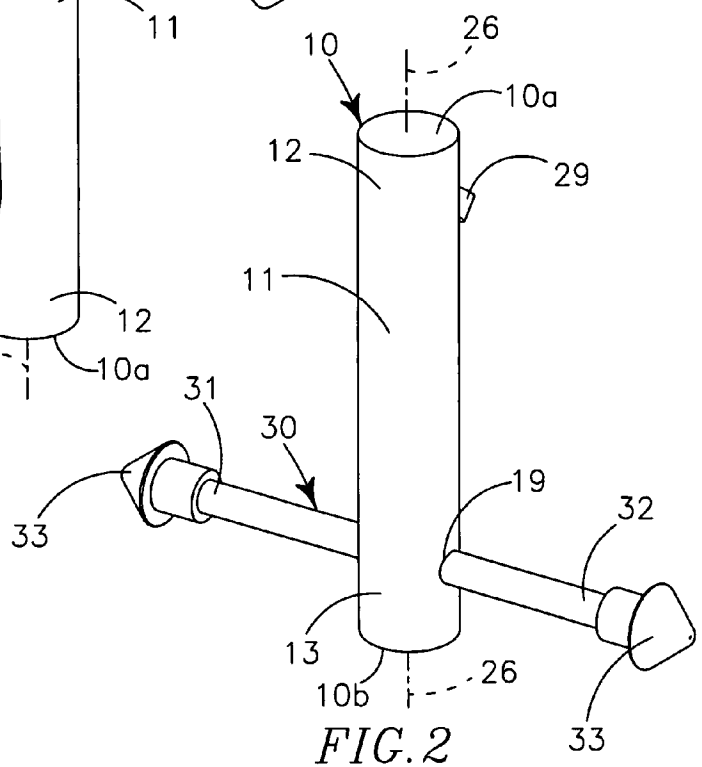
FIG. 2
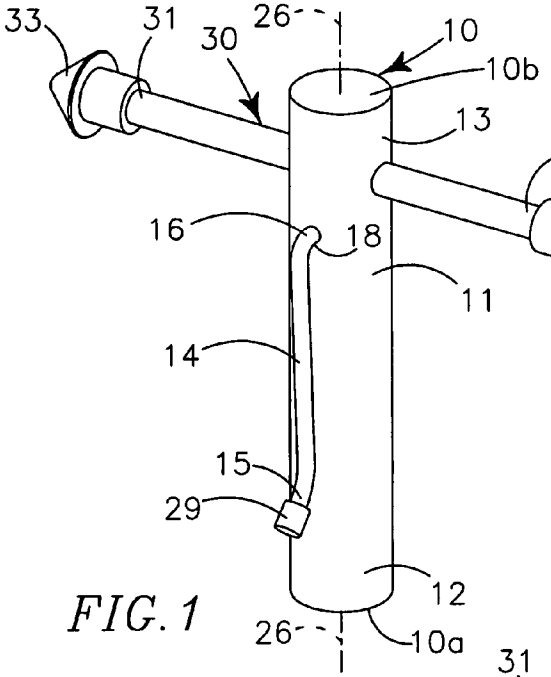
FIG. 1

DEVICE FOR RELEASABLY SECURING A FLEXIBLE BAG ABOUT THE RIM OF A SUPPORTING RECEPTACLE

RELATED APPLICATIONS

This Application claims the benefit of earlier filed U.S. Provisional Patent Application No. 61/133,992 filed on Jul. 3, 2008.

BACKGROUND OF INVENTION

1. Field of Invention

This invention relates to fasteners, and more particularly to a device for releasably securing a flexible bag-type liner about the upper outer circumference of a supporting receptacle.

2. Background and Description of Prior Art

It is a common practice in commercial and household locations to use one size of a waste receptacle in one location, and to use a different size waste receptacle in another location, for instance in a first case in a kitchen, and in a second case a bathroom. Flexible plastic bags are commonly used as replaceable liners inside such waste receptacles for easy and sanitary disposal of waste and trash deposited therein.

Because such bag type liners are replaced so frequently, they are commonly purchased in large quantities and the same size liner is used in a variety of receptacles regardless of the receptacle size.

It is not common for such liner bags to fit firmly and tightly in an installed position. Most of the time the liner bag is relatively large compared to the receptacle whereby some portion of the liner fits loosely within the receptacle and an upper end opening portion of the liner extends loosely outwardly and downwardly relative to upper rim of the receptacle.

When the trash bag liner has sufficient depth from top to bottom, the closed bottom portion rests directly upon the interior bottom of the receptacle. The result is that material deposited within the liner rests upon the interior bottom of the receptacle and trash bag liner will generally remain in position because the upper edge portions of the liner are not pulled downwardly into the receptacle.

However, when the trash bag liner and the receptacle have approximately the same vertical dimension, when the trash bag liner is not as deep as the receptacle, or when extreme loads are placed in the receptacle the upper edge portions of the liner will be pulled downwardly into the receptacle, when material is deposited therein. This may not be a significant issue for office type waste such as paper and envelopes, but can be a significant issue if the liner is being used in a kitchen waste receptacle where food waste, and the like, is deposited because fluids, and semi-fluids and the like may leak outside of the liner into the waste receptacle causing nuisances that may be indelicate as well as odoriferous.

Various apparatus are known for securing an upper edge portion of a flexible bag type liner around the rim of a waste receptacle. Known apparatus include stretchable elastic bands that extend about the receptacle holding the liner in place, tying a knot in an excess portion of the liner gathered about the receptacle, a serrated edge hole or serrated edge slot defined in the side of the receptacle through which twisted excess liner is pulled, spring-biased clamps spaced about the receptacle rim, a "U" shaped apparatus about which excess liner material is wound, an annulus shaped apparatus through which a portion of the excess liner is pulled and an annulus shaped apparatus that extends circumferentially about and engages with the receptacle rim.

Such known apparatus have proved to be ineffective or too expensive for widespread use and continue to suffer from drawbacks including the requirement that the apparatus be attached to a trash receptacle before use, the apparatus is difficult or complicated to operate, the apparatus is expensive to manufacture, the apparatus is integral with the trash receptacle, the apparatus prevents re-use of the liner, the apparatus prevents the receptacle top from fitting appropriately, the apparatus is difficult to remove, the apparatus is limited to use with a specific receptacle, the apparatus is not aesthetically appealing as well as other drawbacks and limitations.

My invention overcomes various of the aforementioned drawbacks by providing a device for securing a flexible bag type liner about the rim of a supporting receptacle that is easy to use, cost effective to manufacture, is not integral with the receptacle, may be used with a plurality of trash receptacles and trash bag type liners, does not interfere with the receptacle top, allows re-use of a bag type liner, remains in place in extreme load conditions, and is easy to remove.

My invention uses the resiliency of the trash bag liner to supply a torquing force that causes one end portion of a rotation handle of my invention to frictionally engage with the receptacle. Engagement of the rotation handle with the receptacle prevents my invention from rotating axially which would allow the liner to unwind from around body portion of my invention.

My invention does not reside in any one of the identified features individually but rather in the synergistic combination of all of its structures, which give rise to the functions necessarily flowing therefrom as hereinafter specified and claimed.

SUMMARY

A fastener for releasably securing a flexible trash bag type liner about the outer upper peripheral rim of a supporting receptacle has an elongated body with a first leg and an interconnected second leg defining a space there-between. An axially movable rotation handle carried at one end portion of the body facilitates rotating the body axially to wind an excess portion of an edge portion of the flexible trash bag type liner about the body and prevents the unwinding of the excess portion of the liner from the body.

In providing such an apparatus it is:

a principal object to provide a fastener which stretches an edge portion of a flexible bag type liner about upper peripheral rim of a supporting receptacle;

a further object to provide a fastener that is easy to operate;

a further object to provide a fastener which may be used on a variety of supporting receptacles without regard to size or shape;

a further object to provide a fastener that may be used with a variety of flexible bag type liners without regard to size or shape;

a further object to provide a fastener that engages with the supporting receptacle below the receptacle's upper peripheral rim and so that operation of receptacle top is not inhibited;

a further object to provide a fastener that maintains the flexible bag type liner in place when the receptacle is being emptied allowing reuse of the liner;

a further object to provide a fastener to does not require modification of the receptacle;

a further object to provide a fastener which positionally maintains the flexible bag liner in a receptacle under extreme load conditions;

a further object to provide a fastener that is easy to use and cost effective to manufacture;

a still further object to provide a fastener that does not interfere with the receptacle axially "sliding" into a larger diameter receptacle sleeve;

a still further object to provide a fastener that does not subject the user's fingers to risk of injury.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

FIG. 1 is an isometric front, top and right side view of my fastener for releasably securing a flexible bag about the rim of a supporting receptacle.

FIG. 2 is an isometric back, bottom and right side view thereof.

FIG. 3 is an orthographic front view thereof.

FIG. 4 is an orthographic right side view thereof.

FIG. 5 is an orthographic left side view thereof.

DESCRIPTION OF PREFERRED EMBODIMENT

Figure 6:
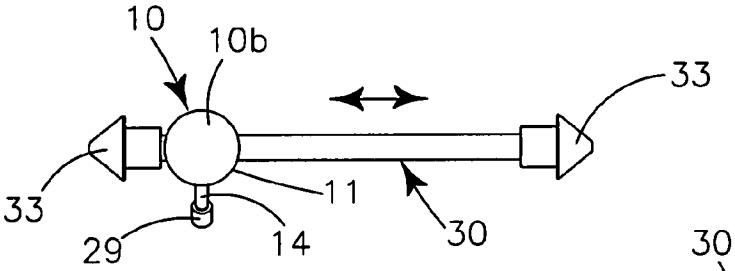
FIG. 6 is an orthographic top view thereof showing the rotation handle moved axially to a first extended position.
Figure 7:
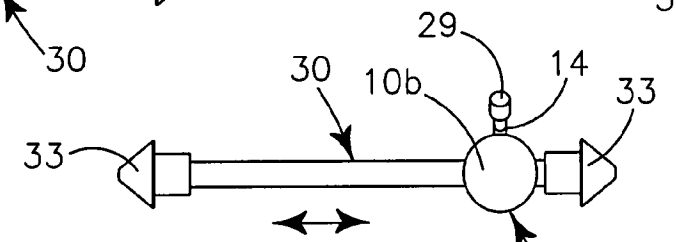
FIG. 7 is an orthographic bottom view thereof showing the rotation handle moved axially to a second extended position.

A fastener for releasably securing a flexible bag about the rim of a supporting receptacle generally provides a body 10 and a rotation handle 30.

The body 10 has first leg 11 and a spacedly adjacent second leg 14. The first leg 11 has a first end portion 12 and an opposing second end portion 13. The second leg 14 has a first end portion 15 and an opposing second end portion 16. Portion of the body 10 proximal the first end portion 12 of the first leg 11 and first end portion 15 of the second leg 14 may hereafter be referred to as first end portion 10*a* of the body 10. Likewise, portion of the body 10 proximal the second end portion 13 of the first leg 11 and second end portion 16 of the second leg 14 may hereafter be referred to as second end portion 10*b* of the body 10.

Space 17 is defined between the first leg 11 and the second leg 14 and is elongate having a vertex 18 at interconnection of first leg 11 and second leg 14 proximal the second end portions 13, 16. Opening 37 is opposite the vertex 18 and proximate the first end portions 12, 15. As shown in FIGS. 1 through 8, in my preferred embodiment the first leg 11 is larger in diameter 22 and longer in length 24 than the second leg 14.

Second end portion 16 of the second leg 14 is interconnected with the first leg 11 proximate the vertex 18, and the first end portion 15 of the second leg 14 is spaced apart from the first portion 12 of the first leg 11 defining the opening 37 therebetween through which an edge portion 45 of the flexible bag type liner 44 may be inserted into the space 17. Enlargement 29 on the first end portion 15 of the second leg 14 enhances frictional engagement with the edge portion 45 of the flexible bag type liner 44.

Rotation handle 30 has a first end portion 31 and a spaced apart second end portion 32 and is carried in diametrically extending handle hole 19 defined in the body 10 proximal the second end portion 10*b*. The first end portion 31 and second end portion 32 of the rotation handle 30 extend laterally outwardly from axis 26 of the body 10 and provide a lever arm for user to rotate the body 10 about axis 26.

Rotation handle 30 extends generally radially perpendicularly from the body 10 and is axially movable within handle hole 19. (See FIG. 6 and FIG. 7). End caps 33 are carried at the first and second end portions 31, 32 respectively to prevent the rotation handle 30 from being unintentionally withdrawn from handle hole 19, and to facilitate gripping during use.

Figure 9:
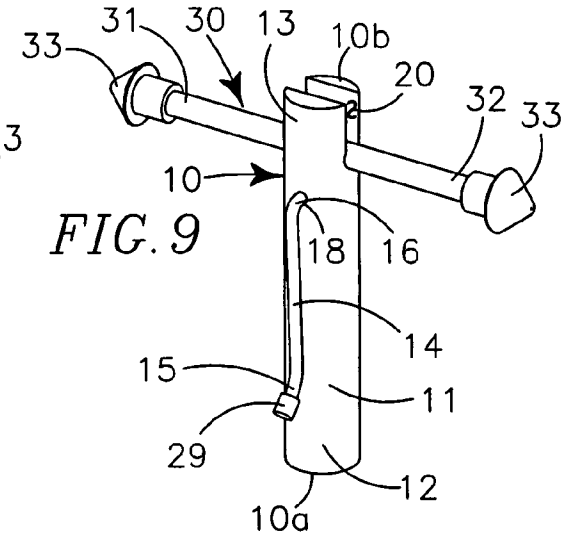
FIG. 9 is an isometric front, top and right side view of a second embodiment of my fastener showing the rotation handle carried in a handle notch.
Figure 10:
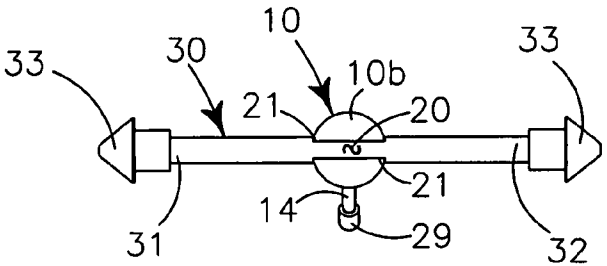
FIG. 10 is an orthographic top view of the second embodiment of my invention showing the handle notch protuberances.

In a second embodiment, as shown in FIG. 9 and FIG. 10, the rotation handle 30 is carried within diametrically extending handle notch 20 defined in the second end portion 13 of the first leg 11. The rotation handle 30 is maintained within the handle notch 20 by radially inwardly extending protuberances 21 that frictionally communicate with outer circumferential surface of rotation handle 30 between the first and second end portions 31, 32. Protuberances 21 positionally maintain the rotation handle 30 within the handle notch 20, and allow axial movement of the rotation handle 30, relative to the first leg 11, between a first extended position (FIG. 6) and a second extended position (FIG. 7) as desired. The second embodiment of my invention, (FIGS. 9, 10) is suited for single piece manufacture of the rotation handle 30 and the body 10 allowing the rotation handle 30 and body 10 to be "snapped" together for assembly.

As shown in FIGS. 11 through 14 in a third embodiment my invention is more planar than cylindrical, and the first leg 11 and the spaced apart second leg 14 are approximately the same length 24 and have the same thickness 23. The first leg 11 and the second leg 14 each have a first end portion 12, 15 respectively and a second end portion 13, 16 respectively communicating with a laterally extending rotation handle 30 communicating with the second end portions 13, 16.

Space 17 is defined between the first leg 11 and second leg 14 and is somewhat triangular in shape having a vertex 18 proximate the rotation handle 30 and medially between the first leg 11 and second leg 14. Opening 37 is defined between the first leg 11 and second leg 14 opposite the rotation handle 30.

First end portion 31 and second end portion 32 of rotation handle 30 extend laterally outwardly from lateral edges 11*a*, 14*a* of the first leg 11 and second leg 14 providing a lever arm for axial rotation of the body 10.

Protuberances 38 extend laterally outwardly from lateral edges 11*a*, 14*a* of the first leg 11 and the second leg 14 proximate the first end portions 12, 15 respectively opposite space 17 and opening 37. Protuberances 38 enhance frictional engagement of the first leg 11 and second leg 14 with the flexible bag type liner 44 as the edge portion 45 of the liner 44 is wound about the first and second legs 11, 14.

Figure 13:
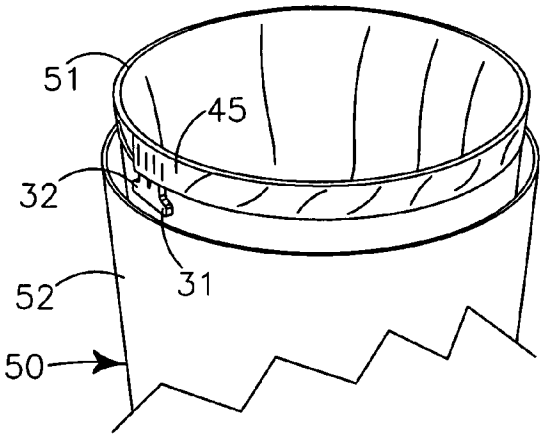
FIG. 13 is an isometric partial cut-away top and side environmental view showing the third embodiment of my fastener securing a flexible bag type liner about the upper peripheral rim of an inner element of a "sleeve-type" trash receptacle.
Figure 14:
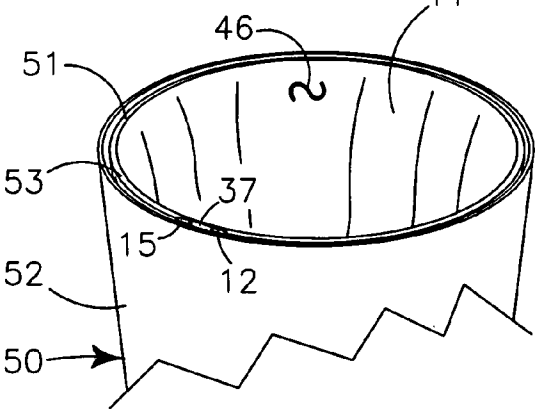
FIG. 14 is a view similar to that of FIG. 13 showing my fastener in an operative position with the inner element of a "sleeve-type" trash receptacle carried fully within a diametrically larger outer element.
Figure 12:
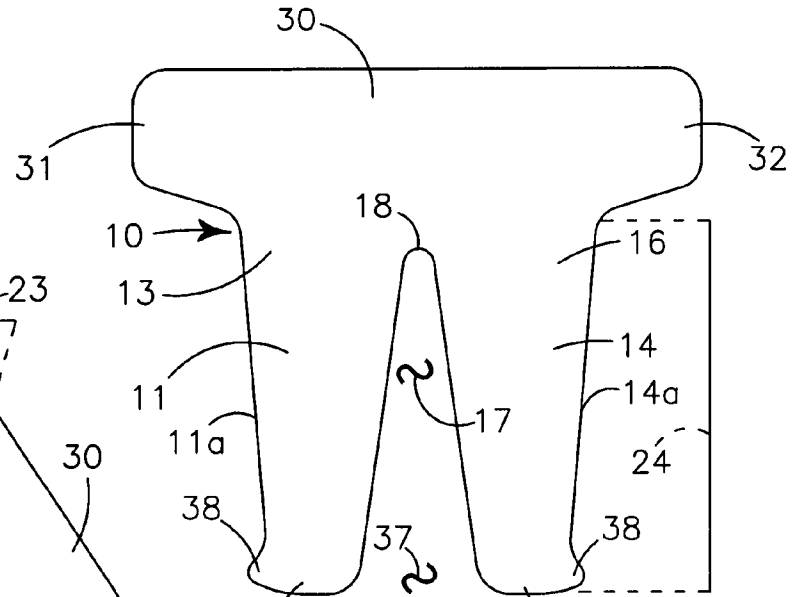
FIG. 12 is an orthographic front view of the third embodiment of my fastener.
Figure 11:
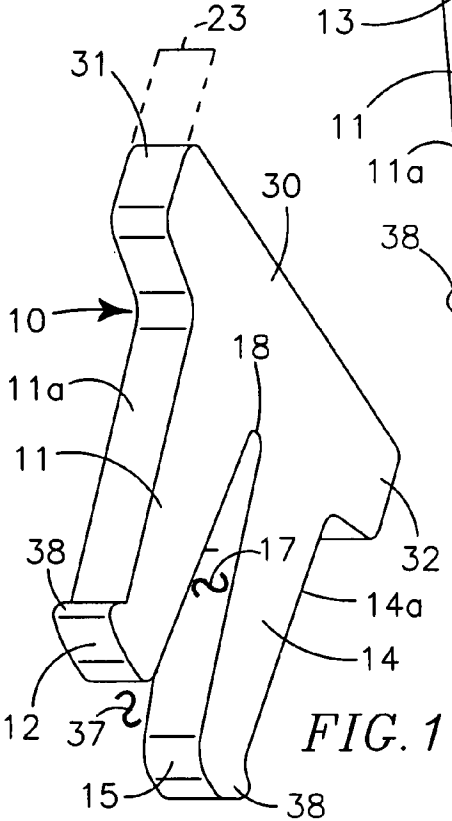
FIG. 11 is an isometric front, side and bottom view of a third embodiment of my fastener for releasably securing a flexible bag about the rim of a supporting receptacle.

Thickness 23 of the body 10 is between approximately 2.5 millimeters and 10 millimeters and is optimally approximately 5 millimeters so that the third embodiment of my invention may be used to secure a flexible bag type liner 44 about upper peripheral rim 53 of an inner member 51 of a sleeve-type trash receptacle 50 as shown in FIG. 13 and FIG. 14. The minimal thickness 23 of the body 10 allows my invention to be placed in adjacency to upper outer peripheral rim 53 of inner member 51 and allows the inner member 51 slide axially into the chamber (not shown) defined by outer member 52 of the sleeve type trash receptacle 50 without interfering with the operation of any movable receptacle top (not shown).

My fastener is preferably formed of poly-carbonate which provides a durable, rigid and cost effective material that may be molded, extruded or stamped for ease of manufacture, is easy to clean and is not subject to bacterial contamination and the like. Other materials having similar desirable characteristics include but are not limited to metallic alloys, ceramics, Plexiglas, nylon, fiberglass, carbon fiber, polypropylene and the like.

Having described the structure of my device for releasably securing a flexible bag about the rim of a supporting receptacle its operation may be understood.

Figure 8:
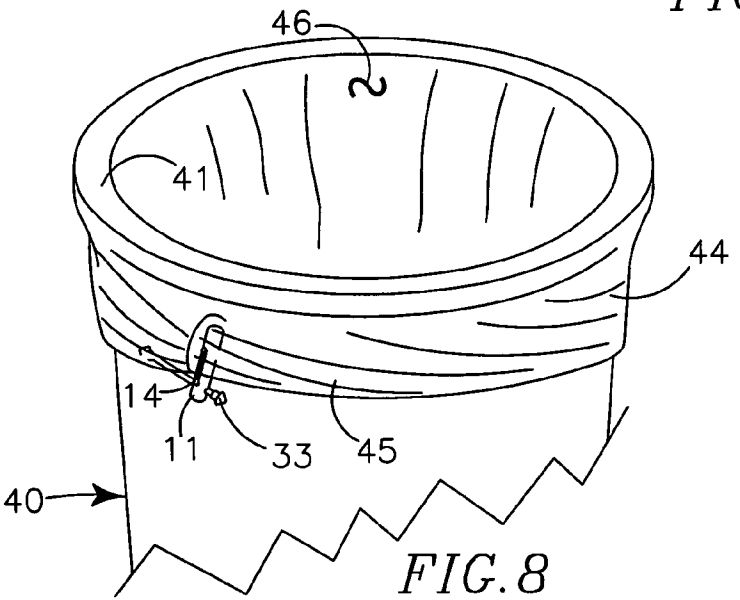
FIG. 8 is an isometric partial cut-away top and side environmental view of my fastener securing a flexible trash bag type liner about an upper outer peripheral rim of a supporting receptacle.

As shown in FIG. 8, a flexible bag type liner 44 is placed within a supporting receptacle 40 so that bottom portion (not shown) of the flexible bag type liner 44 is within receptacle chamber 46 and the upper edge portion 45 of the liner 44 is folded over and downwardly about the receptacle rim 41. Edge portion 45 of liner 44 is inserted through opening 37 and into space 17 defined between the first leg 11 and the second leg 14 so that the edge portion 45 is in direct physical contact with the vertex 18.

Body 10 is rotated about axis 26 using the rotation handle 30 by twisting in a clockwise direction or a counterclockwise direction. The axial rotation of the body 10 causes a portion of the edge portion 45 of the bag type liner 44 extending over and about the receptacle rim 41 to wind around the first leg 11 and second leg 14. As the flexible bag type liner 44 is wound about the first and second legs 11, 14 respectively, the edge portion 45 of the liner 44 is stretched about the outer circumference of the receptacle 40 spacedly below the receptacle rim 41. Because the bag type liner 44 has inherent resiliency, the stretching of the edge portion 45, as it is wound about the first and second legs 11, 14, creates a torquing force (not shown) in a direction opposite to which the body 10 has been rotated to wind the bag type liner 44 thereabout.

The winding of the flexible bag type liner 44 about the first and second legs 11, 14 may cause the body 10 to bias to a somewhat horizontal orientation as shown in FIG. 8 as the edge portion 45 of the liner 44 is stretched. Rotation handle 30 is then moved axially within handle hole 19 to the first extended position, or the second extended position so that one end cap 33 is in direct frictional contact with the body 10 and the opposing end cap 33 is in frictional contact with the receptacle 40. The rotation handle 30, in such extended position, acts as a lever arm which prevents the body 10 from rotating axially responsive to the torquing force (not shown) exerted by the stretched liner 44. The extended rotation handle prevents rotation of the body 10 and positionally maintains the bag type liner 44 in engagement with the receptacle 40 even under extreme load conditions.

Having thusly described my invention, what I desire to protect by Letters Patent, and

I claim :

1. A fastener for releasably securing an upper edge portion of a flexible bag type liner about the rim of a supporting receptacle, the fastener comprising in combination:

an elongate body defining an elongate axis and having a first leg with first and second opposing end portions and a second leg interconnected with the first leg at a second end portion proximal to the first leg second end portion and with an opposing first end portion proximal to the first end portion of the first leg, and an elongate space defined between the first leg and the second leg extending from the interconnection;

a rotation handle carried by the body between the body second end portion and the interconnection of the first and second legs, the rotation handle having first and opposing second end portions extending from the body to aid rotation of the body about the axis;

distance between the first and second end portions of the rotation handle is greater than combined thickness of the first leg, plus thickness of the second leg plus width of the space defined between the first leg and the second leg; and the rotation handle is carried in an axially orthogonal handle hole defined in the first leg proximate the second end portion.

2. The fastener of claim 1 wherein:

the rotation handle is carried in an axially orthogonal handle notch defined in the second end portion of the first leg.

3. The fastener of claim 1 wherein:

the second leg is shorter in length than the first leg.

4. The fastener of claim 1 wherein:

the first leg and the second leg are substantially similar in length.

5. The fastener of claim 1 further comprising:

a protuberance on at least one leg proximal to the first end portion for engagement with the flexible bag to aid positional maintenance within the space between the first and second legs.

6. The fastener of claim 1 further comprising:

end caps carried at the first and second end portions of the rotation handle.

* * * * *